US007502483B2

(12) United States Patent
Rikimaru

(10) Patent No.: US 7,502,483 B2
(45) Date of Patent: Mar. 10, 2009

(54) HEARING AID, TRAINING DEVICE, GAME DEVICE, AND AUDIO OUTPUT DEVICE

(75) Inventor: Hiroshi Rikimaru, 1-7-12-505, Takanohigashibirakicho, Sakyo-ku, Kyoto-shi, Kyoto (JP) 606-8107

(73) Assignee: Hiroshi Rikimaru, Kyoto (JP)

( * ) Notice: Subject to any disclaimer, the term of this patent is extended or adjusted under 35 U.S.C. 154(b) by 665 days.

(21) Appl. No.: 10/530,342

(22) PCT Filed: Oct. 6, 2003

(86) PCT No.: PCT/JP03/12801

§ 371 (c)(1),
(2), (4) Date: Apr. 6, 2005

(87) PCT Pub. No.: WO2004/034739

PCT Pub. Date: Apr. 22, 2004

(65) Prior Publication Data

US 2007/0003083 A1 Jan. 4, 2007

(30) Foreign Application Priority Data

Oct. 10, 2002 (JP) ..... 2002-297635

(51) Int. Cl.
*H04R 25/00* (2006.01)
*H04R 29/00* (2006.01)

(52) U.S. Cl. ..... 381/320; 381/56

(58) Field of Classification Search ..... 381/56, 381/60, 77, 320
See application file for complete search history.

(56) References Cited

U.S. PATENT DOCUMENTS 5,303,327 A * 4/1994 Sturner et al. ..... 704/270
6,109,107 A * 8/2000 Wright et al. ..... 600/559
6,322,521 B1 11/2001 Hou

FOREIGN PATENT DOCUMENTS

JP 62-262600 A 11/1987

(Continued)

OTHER PUBLICATIONS

Office Action.

(Continued)

*Primary Examiner*—Brian Ensey
(74) *Attorney, Agent, or Firm*—Carrier, Blackman & Associates, P.C.; Joseph P. Carrier; William D. Blackman

(57) ABSTRACT

The present invention provides a hearing aid in which at least one portion of an input sound signal is divided into a frequency band signal, and a single or a plurality of the frequency band signals are subjected to noise to generate a Noise-Vocoded Speech Sound signal, which a user can hear. Such a hearing aid facilitates activation of the brain and is expected to provide an effect on treatment or training of people with a neural disorder. Such a hearing aid lets a Noise-Vocoded Speech Sound signal recognized by utilizing normal portions of the brain to the maximum level and the Noise-Vocoded Speech Sound signal is compensated for by other normal portions of the brain, in order to let a person with hearing difficulty understand the meaning of the input sound.

21 Claims, 7 Drawing Sheets

FOREIGN PATENT DOCUMENTS

| | | | |
|---|---|---|---|
| JP | 05-176933 | A | 7/1993 |
| JP | 05-316597 | A | 11/1993 |
| JP | 06-073800 | U | 10/1994 |
| JP | 09-000590 | A | 1/1997 |
| JP | 09-258787 | A | 10/1997 |
| JP | 2000-003200 | A | 1/2000 |
| JP | 2000-022603 | A | 1/2000 |
| JP | 2000-125397 | A | 5/2000 |
| JP | 2000-152394 | A | 5/2000 |
| JP | 2000-293353 | A | 10/2000 |
| JP | 2000-308198 | A | 11/2000 |
| JP | 2002-6900 | A | 1/2002 |

OTHER PUBLICATIONS

International Search Report mailed on Jan. 12, 2004.

* cited by examiner

【FIG. 1】
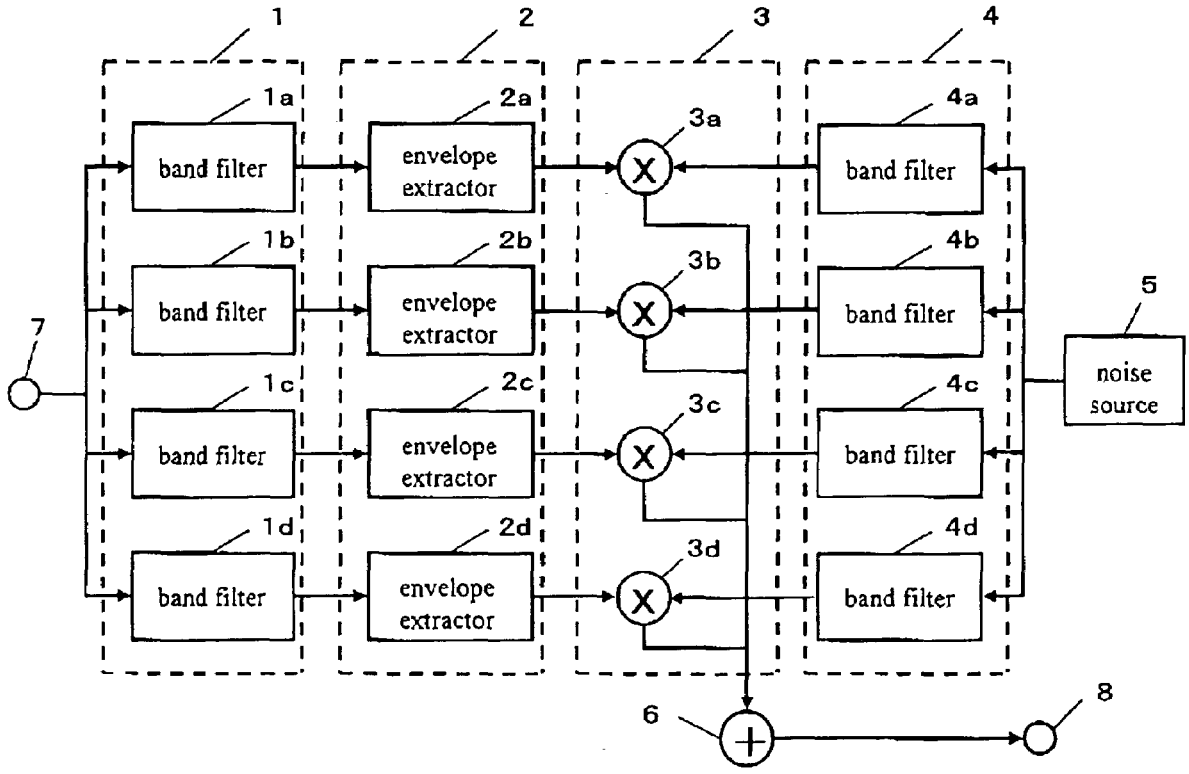

【FIG. 2】
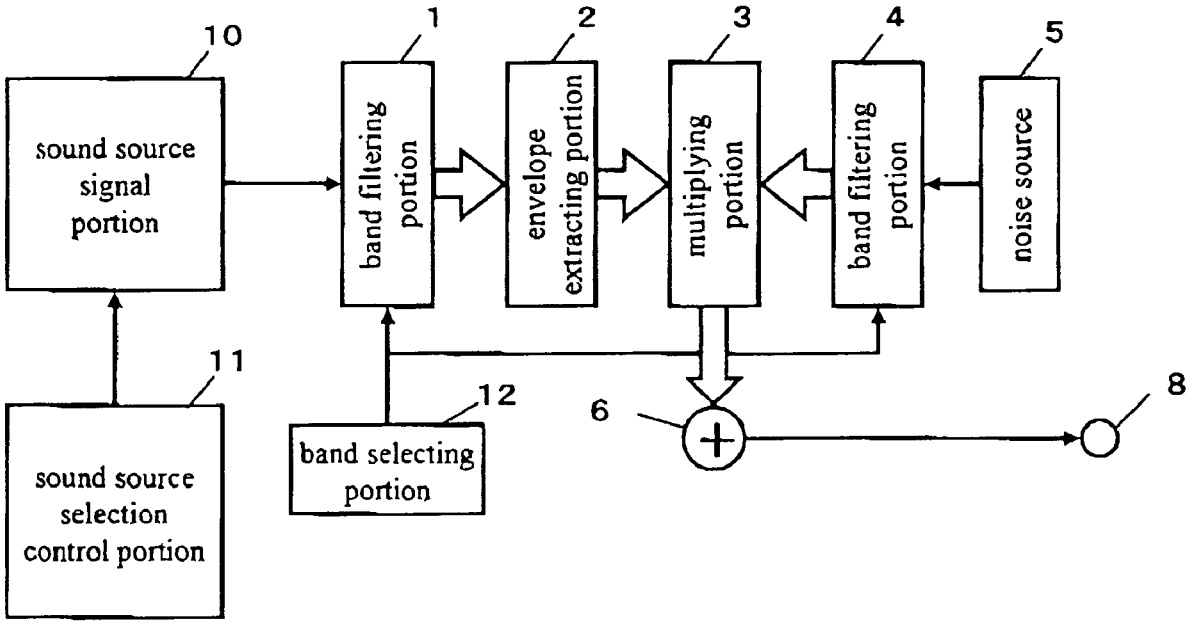

【FIG. 3】
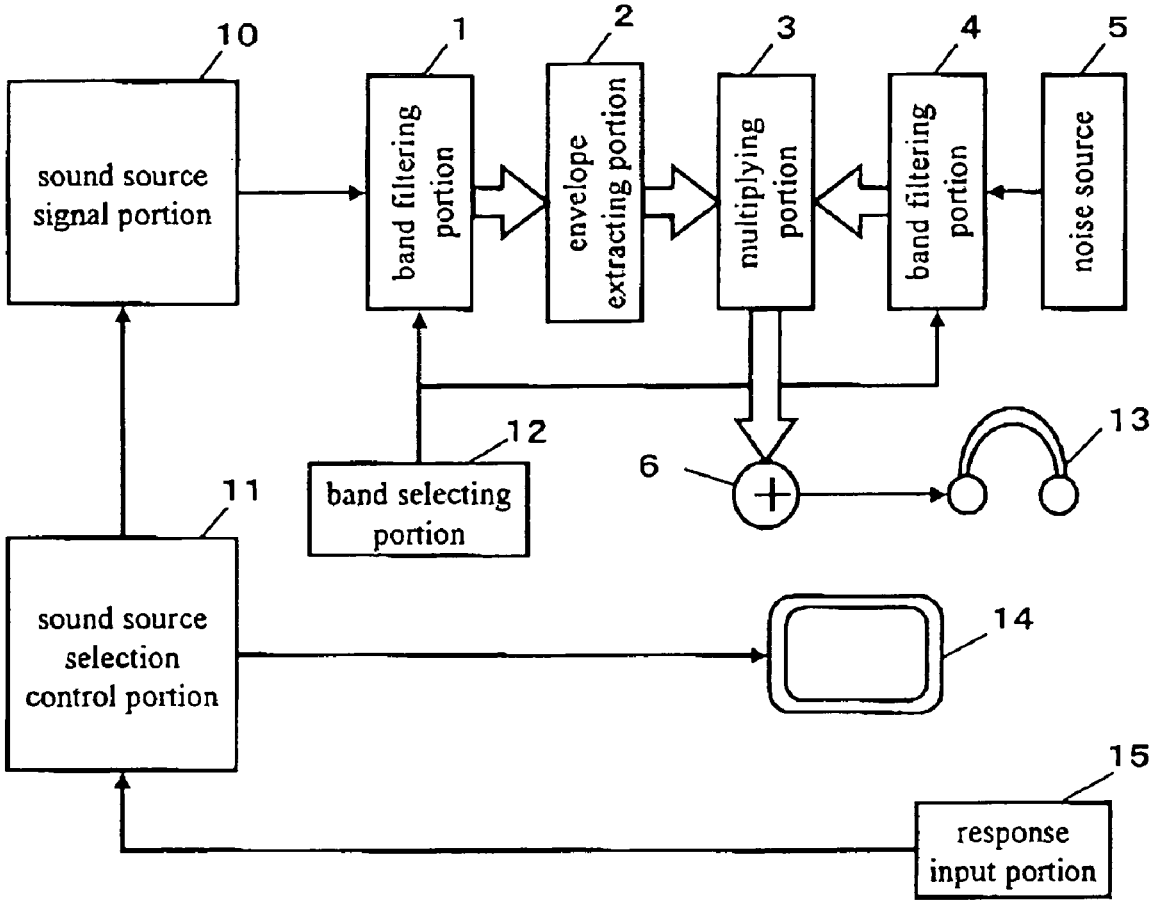

【FIG. 4】
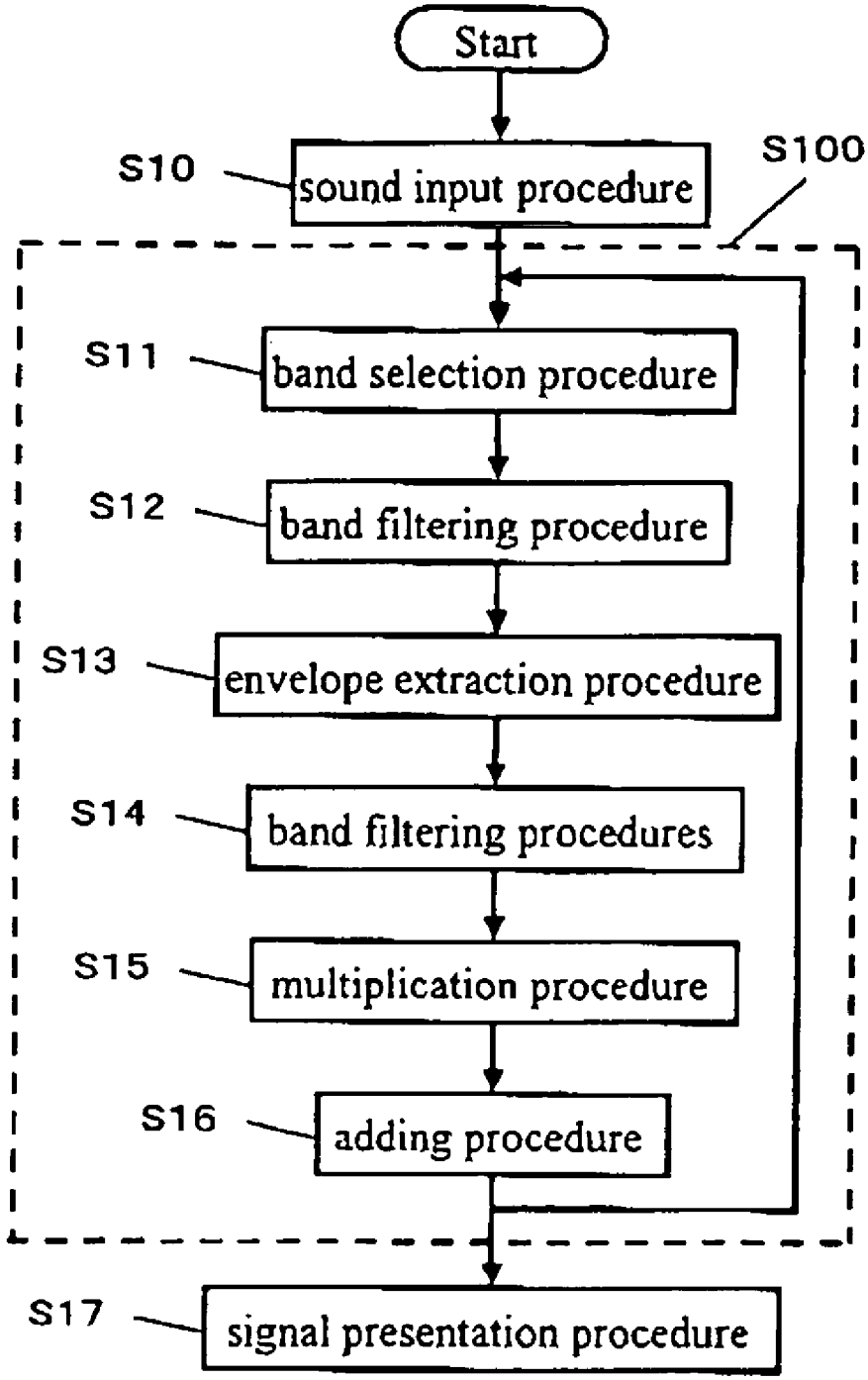

【FIG. 5】
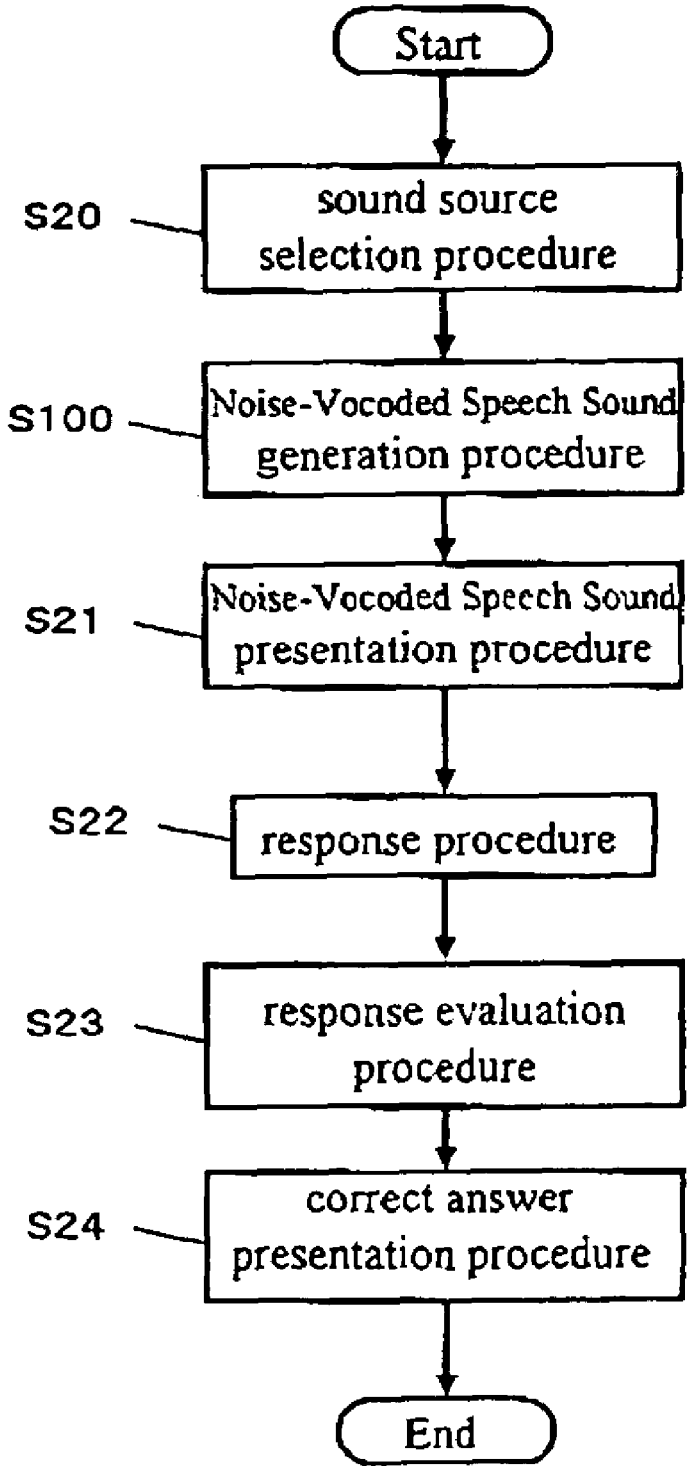

【FIG. 6】
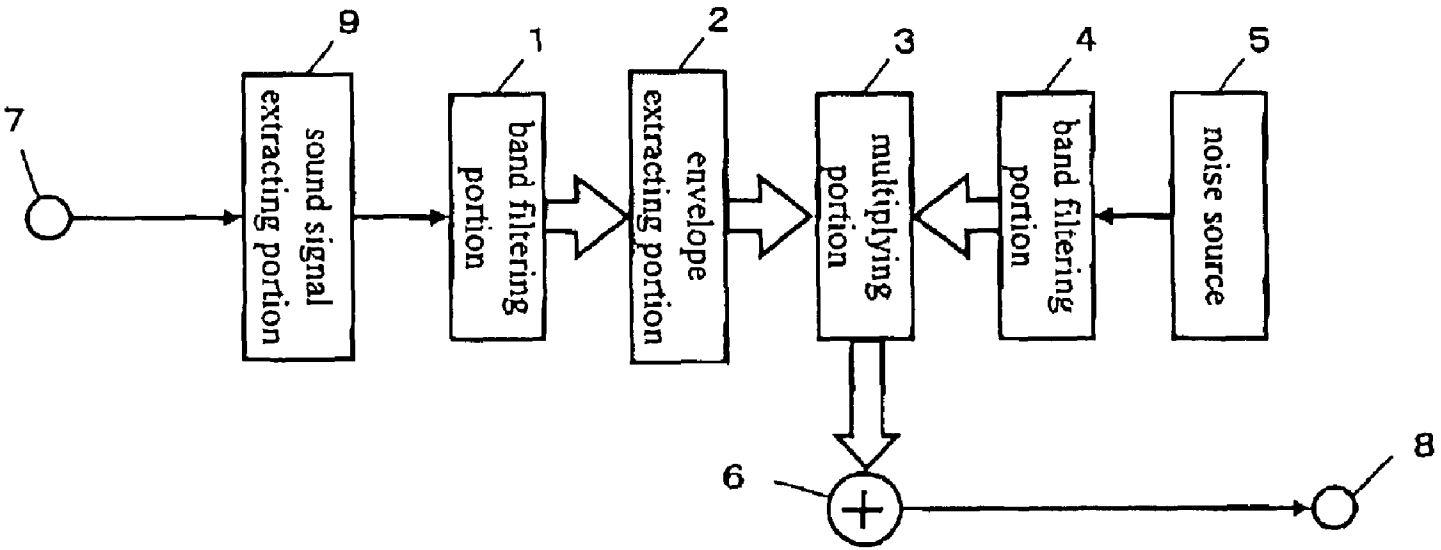

【FIG. 7】
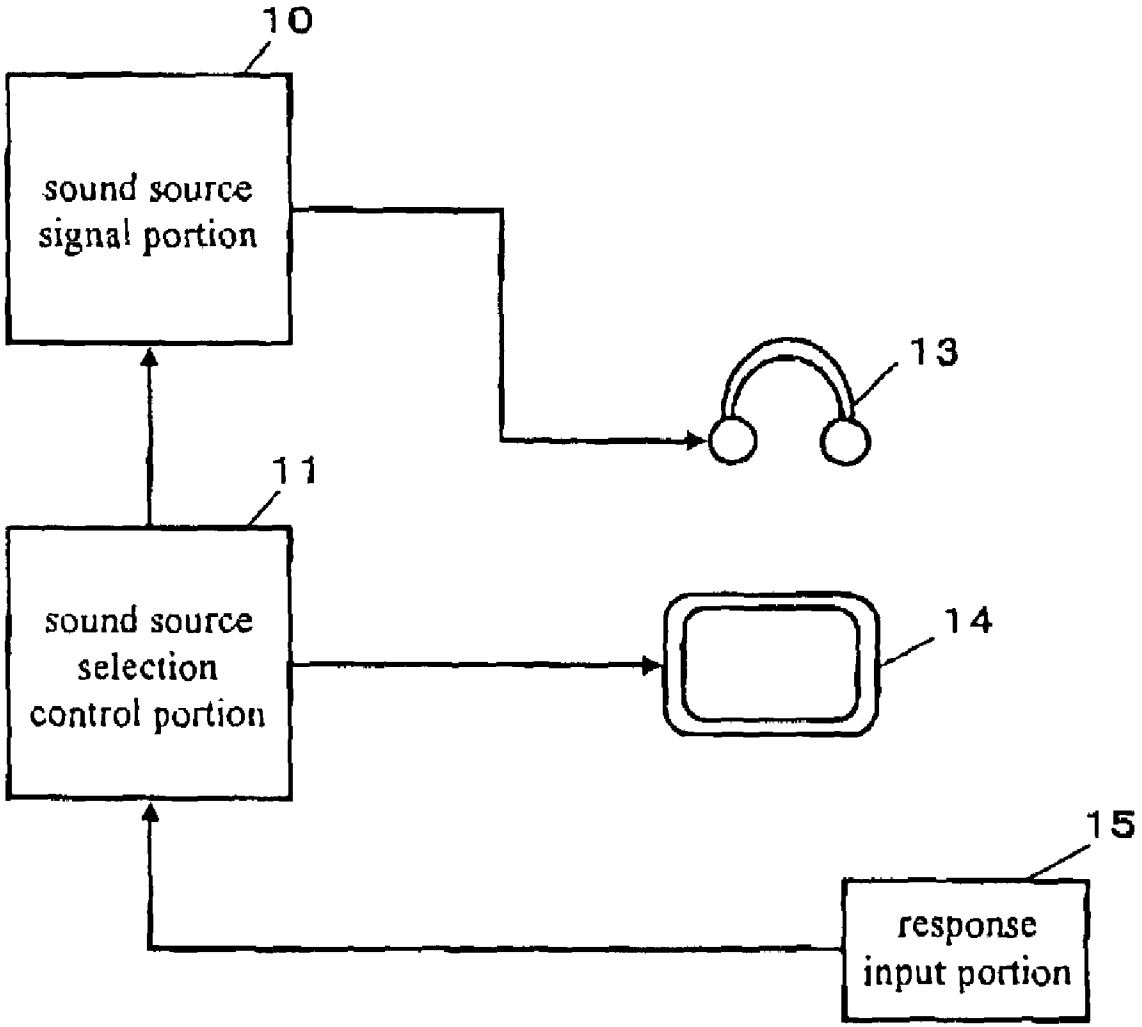

HEARING AID, TRAINING DEVICE, GAME DEVICE, AND AUDIO OUTPUT DEVICE

TECHNICAL FIELD

The present invention relates to a hearing aid, a hearing training device, a game device and other devices that employ Noise-Vocoded Speech Sound obtained by subjecting at least one frequency band signal of a sound signal to noise. In particular, the present invention relates to devices suitable to people with a neural disorder and trainers for training for recovery from a neural disorder.

BACKGROUND ART

Conventionally, in some hearing aids, frequency characteristics compensation or limitation of a dynamic range is performed with respect to audio input in accordance with the hearing characteristics that are left for a person with hearing disorder in order to improve the intelligibility. For people with a neural disorder, such a hearing aid may not be capable of providing sufficient intelligibility.

On the other hand, in research on recognition of sound signals, it has come to be known that a speech can be recognized to a considerable extent without hearing a complete sound signal, that is, even if a component of a sound signal is subjected to noise by a predetermined method.

According to such a research, a sound signal is divided into four frequency bands (0 to 600, 600 to 1500, 1500 to 2500, 2500 to 4000 Hz), each sound signal is subjected to half-wave rectification and is applied to a 16 Hz lowpass filter so as to obtain an amplitude envelope of each frequency band, and is multiplied by a band noise corresponding to each frequency band, and the thus obtained signals are added to generate a signal. Such a signal is referred to as "Noise-Vocoded Speech Sound". It has been reported that when people with normal hearing ability heard the Noise-Vocoded Speech Sound, an intelligibility of about 80% was obtained.

However, conventional hearing aids often do not provide an adequate intelligibility to people with neural disorders or some of the people with hearing disorders. It is necessary to provide a hearing aid that has an effect on such people and further allows brain activity to be activated. Furthermore, it is necessary to provide a device for training the hearing ability of people with a neural disorder or some of the people with hearing disorders. Moreover, it is necessary to train people with normal hearing ability to recognize speeches produced by people with a neural disorder.

DISCLOSURE OF INVENTION

The present invention provides a hearing aid in which at least one portion of an input sound signal is divided into frequency band signals and a single or a plurality of the frequency band signals are subjected to noise to generate a Noise-Vocoded Speech Sound signal, which a user can hear. Such a hearing aid facilitates activation of the brain and is expected to provide an effect on treatment or training of people with a neural disorder. Such a hearing aid allows a Noise-Vocoded Speech Sound signal to be recognized by utilizing normal portions of the brain to the maximum level and the Noise-Vocoded Speech Sound signal is compensated for by other normal portions of the brain, in order to let a person with hearing difficulty understand the meaning of the input sound.

The present invention provides a training device in which a Noise-Vocoded Speech Sound signal obtained by dividing at least one portion of a sound signal into frequency band signals and subjecting a ingle or a plurality of the frequency band signals to noise to a trainee, the trainee pronounces the recognized words and learns the correctness of same. Such a training device has an effect of promoting the activation of the brain activity. Such a training device is useful in training a trainee to understand language and, for trainers, this is useful in training for improving the training ability. Such a training device also allows a Noise-Vocoded Speech Sound signal to be recognized by utilizing normal portions of the brain to the maximum level and the Noise-Vocoded Speech Sound signal is compensated for by other normal portions of the brain, in order to let a person with hearing difficulty understand the meaning of the input sound.

The present invention provides a game device in which a Noise-Vocoded Speech Sound signal obtained by dividing at least one portion of a sound signal into frequency band signals and subjecting a single or a plurality of the frequency band signals to noise to a game player, the game player pronounces the recognized words and competes in the ratio of correctness or the number of correct answers. Such a game device has an effect of promoting the activation of the brain activity. Such a game device is also useful in training a trainee to understand language and, for trainers, this is useful in training for improving the training ability. Apart from training, such a game device can be a game device for normal people as a game for guessing words or sentences from the Noise-Vocoded Speech Sound.

Furthermore, a sound output device of the present invention generates a Noise-Vocoded Speech Sound signal in which a component of a sound source signal is subjected to noise by extracting a signal with a predetermined frequency band from the sound source signal by a first band filtering portion having a plurality of band filters; extracting an amplitude envelope of each frequency band signal by an envelope extracting portion having an envelope extractor; applying a noise source signal to a second filtering portion having a plurality of band filters to extract a noise signal corresponding to the predetermined frequency band; multiplying an output from the first band filtering portion by an output from the second band filtering portion in a multiplying portion; and accumulating outputs from the multiplying portion in an adding portion. If this sound output device is configured so that the number of band filters or the frequency boundary of the frequency bands can be selected or changed, this sound output device can be used for various purposes. Furthermore, with automatic language recognition, when the number of band filters or the frequency boundary of the frequency bands is selected or changed suitably with a language, this device can be used by a plurality of peoples with different nationalities, and can be used for training of foreign languages.

The hearing aid, the training device, and the game device of the present invention can be implemented with the procedures of a computer program or the like, and therefore can be made into a program recording medium storing a program that is executed by a computer or a program that is executed by a computer.

BRIEF DESCRIPTION OF DRAWINGS

FIG. 1 is a block diagram of a hearing aid according to one embodiment of the present invention.

FIG. 2 is a block diagram of a training device according to one embodiment of the present invention.

FIG. 3 is a block diagram of a training device or a game device according to one embodiment of the present invention.

FIG. 4 is a flowchart showing the behavior of a hearing aid according to one embodiment of the present invention.

FIG. 5 is a flowchart showing the behavior of a training device or a game device according to one embodiment of the present invention.

FIG. 6 is a block diagram of a hearing aid according to one embodiment of the present invention.

FIG. 7 is a block diagram of a training device according to one embodiment of the present invention.

BEST MODE FOR CARRYING OUT THE INVENTION

Hereinafter, embodiments of a hearing aid and the like will be described with reference to the accompanying drawings. It should be noted that components bearing the same reference numeral in the embodiments perform the same operation and may not be described in duplicate.

Embodiment 1

FIG. 1 is a block diagram of a hearing aid of the present invention. In FIG. 1, a sound signal input from a microphone is applied to a band filtering portion 1 via an input terminal 7. The band filtering portion 1 has a plurality of band filters 1*a*, 1*b*, 1*c* and 1*d* for extracting signals having a predetermined frequency band. Output signals from the band filters 1*a*, 1*b*, 1*c* and 1*d* are applied to envelope extractors 2*a*, 2*b*, 2*c* and 2*d*, respectively, of an envelope extracting portion 2 so that the amplitude envelope of each frequency band signal is extracted. A noise signal output from a noise source 5 is applied to a band filtering portion 4 having a plurality of band filters 4*a*, 4*b*, 4*c* and 4*d*, to be divided into noise signals having the same frequency bands as those of the band filtering portion 1. The outputs from the envelope extractors 2*a*, 2*b*, 2*c* and 2*d* and the outputs from the band filters 4*a*, 4*b*, 4*c* and 4*d* are multiplied for each corresponding band in a multiplying portion 3 having multipliers 3*a*, 3*b*, 3*c* and 3*d*. The multiplied results are summed up in an adding portion 6, and then become output signals in an output terminal 8.

When the thus-created Noise-Vocoded Speech Sound is emitted through an earphone for listening, some of the people with hearing difficulty (e.g., hearing difficulty with a neural disorder) may experience a better intelligibility than with conventional hearing aids, so that the Noise-Vocoded Speech Sound can be used for a hearing aid. More specifically, this allows people with a neural disorder to recognize the Noise-Vocoded Speech Sound with normal portions of the brain, and the brain (in general, portions different from the normal portions) to compensate the portion of audio information that can be recognized so that the input sound can be understood. In other words, according to the above-described hearing aid, the hearing ability can be recovered by utilizing the normal portions of the brain effectively to the maximum.

Furthermore, such a Noise-Vocoded Speech Sound is expected to activate the activity of the brain of a person with a neural disorder, and not only a function of compensation of hearing ability, but also an effect of training for recovery of a brain with disorder or treatment thereof can be expected. Furthermore, in the case of a person with a hearing difficulty who does not have a neural disorder but has a disorder in the acoustic conduction system of the external ear or the middle ear or in the middle from the acoustic perception system of the internal ear to the central nervous system, the Noise-Vocoded Speech Sound can allow the brain to enhance the function of compensating the disorder in the middle so as to improve the illegibility.

Next, a variation of the hearing aid will be described. For example, when a person with hearing difficulty has a poor sensitivity to a certain frequency band, the frequency characteristics that compensate for a reduction in the sensitivity to that frequency can be provided to the frequency characteristics of each band filter. Furthermore, in the case where there is a limit on the range of the sound volume that can be heard so that sound cannot be heard in a small sound volume, and sound cannot be recognized because it is distorted in a large sound volume, then the non-linear multiplication characteristics for correcting the dynamic range as appropriate can be provided to each of the multipliers 3*a*, 3*b*, 3*c* and 3*d* of the multiplying portion 3.

In FIG. 1, the sound signals of all of the four frequency bands are subjected to frequency band noise signals, but sound signals of a part of the frequency bands need not be supplied to the multiplying portion 3 but may be supplied directly to the adder 6, so that sound signal components can be left. Also with respect to each of the frequency bands whose sound signal components are to be left, a correction corresponding to degradation of the dynamic range or the frequency characteristics of hearing disorder may be performed.

As described above, according to the present invention, a hearing aid can be provided in which at least one portion of an input sound signal is divided to a single or a plurality of frequency band signals and subjected to noise to generate Noise-Vocoded Speech Sound signals, which a user can hear, and the activation of the brain can be facilitated by this hearing aid so that an effect on treatment and training of people with a neural disorder can be expected.

Embodiment 2

FIG. 2 is a block diagram of a training device using the Noise-Vocoded Speech Sound of the present invention. In FIG. 2, the band filtering portion 1, the envelope extracting portion 2, the multiplying portion 3, and the band filtering portion 4, the noise source 5, and the adding portion 6 have the same configurations as in those FIG. 1. The sound source signal portion 10 stores sound signals of various words or sentences. A sound source selection control portion 11 selects and designates a sound signal of a predetermined word or sentence by supplying a control signal to the sound signal portion 10. The sound source signal portion 10 outputs the sound signal of the designated word or sentence to the band filtering portion 1. The Noise-Vocoded Speech Sound signal of that word or sentence is obtained from an output terminal 8. This is listened to by a trainee. A trainer operates the sound source selection control portion 11 according to a training program, and has a trainee listen to the words or the sentences sequentially, and the trainee listens to the Noise-Vocoded Speech Sounds and pronounces the recognized words or sentences to the trainer. The trainer judges whether they are correct or incorrect and lets the trainee know the results, and then proceeds to the next step. The trainee learns by being informed of whether their responses are correct or incorrect. The trainer selects words or sentences that are to be supplied next, depending on their accuracy.

For the frequency bands of the band filters of the band filtering portions 1 and 4, 0 to 600 Hz, 600 to 1500 Hz, 1500 to 2500 Hz, and 2500 to 4000 Hz are used as the standard frequency bands. A band selecting portion 12 can switch the above-described frequency bands of the band filtering portions 1 and 4. For example, the number of frequency bands can be selected among 1, 2, 3, and 4. This is because the four frequency bands are necessary, depending on the words, that is, whether the sound is a vowel sound, a consonant, an explosive sound or the like. For example, the number of the frequency bands can be 2 by setting the output from the band filters 1*c*, 1*d*, 4*c* and 4*d* to 0. Furthermore, with respect to all or any part of the band filters, the boundary frequency defining the frequency bands can be switched to other frequencies than 600 Hz, 1500 Hz, 2500 Hz, and 4000 Hz. 600 Hz, 1500 Hz, 2500 Hz, and 4000 Hz are close to the standard frequency boundary that separates the vowel sounds of sound, that is, /a/, /i/, /u/, /e/, and /o/ in Japanese by the first and the second formants. However, the frequency boundary may be slightly different from person to person. It is expected to improve the training effect by adjusting and changing the boundary of the frequency bands in accordance with such a difference between individuals, so that the device is configured such that the boundary can be switched and selected. Furthermore, foreign languages have a vowel system different from that of Japanese, so that the device may be configured such that the number of the band filters or the boundary frequency can be switched in order to be used with foreign languages.

For use with foreign languages, a language automatic recognition portion may be provided and automatically recognize words or sentences that have been input first by a trainee and a trainer through a microphone. Then, the language automatic recognition portion may supply data about the country to the band selecting portion 12, and the band selecting portion 12 may set the number of the band filters and the frequency band boundary corresponding to the language of the country in the band filtering portion 1 and 4.

It should be noted that selection or switching of the number of the band filters and the frequency band boundary, and selection or switching of the number of the band filters and the frequency band boundary by the language automatic recognition portion as described above can be applied to the hearing aid described in Embodiment 1.

As described above, the present invention provides an effect of facilitating the activation of the activity of the brain by the above-described training device. The present invention is useful to train a trainee to understand language or to train a trainer to improve the training ability.

Embodiment 3

FIG. 3 is a block diagram of a training device using the Noise-Vocoded Speech Sound of the present invention. Referring to this block diagram, the aspects that are different from FIG. 2 will be described. The Noise-Vocoded Speech Sound output from the adding portion 6 is presented to a trainee through a headphone 13. The sound source selection control portion 11 has a function of controlling generation of display signals, in addition to the function of selecting a sound source signal, and displays an instruction to a trainee or a response to words or sentences with Noise-Vocoded Speech Sound with texts on a screen of a display device 14. A response input portion 15 is a keyboard with which recognized words or sentences are input. Information signals from the response input portion 15 are transmitted to the sound source selection control portion 11, and the sound source selection control portion 11 analyses the content of the response and selects words or sentences that are to be presented next, according to the response results.

A training program is contained in the sound source selection control portion 11. For example, 10 basic words or sentences constitute one set, and words or sentences are presented sequentially one by one. A trainee listens to the Noise-Vocoded Speech Sound thereof and inputs recognized words or sentences as a response with Japanese characters to the response input portion 15. The sound source selection control portion 11 counts correct and incorrect responses and displays correct answers on the display device 14 and presents again the Noise-Vocoded Speech Sound at the same time. After the presentation of and the responses to the ten words or sentences, the ratio of the correct responses is displayed. Finally, the ten words or the sentences of the problems are presented again for confirmation. Thus, the trainee can learn by himself without a trainer. The sound source selection control portion 11 starts a next problem program having an appropriate difficulty, depending on the ratio of the correct responses.

When presenting the Noise-Vocoded Speech Sound, its sound may be displayed in the display device with texts. For example, a correct sentence and a plurality of partially incorrect sentences that may be misheard easily may be displayed, and a trainee may input the number assigned to the sentence that he/she thinks correct to the response input portion 15.

The selection of the filters in the band filtering portions 1 and 4, the selection and switching of the boundary of the band frequencies and the selection and switching by the language automatic recognition portion, which are described in Embodiment 2, can be applied to this embodiment.

According to this embodiment, with the above-described training device, trainees can be trained by themselves.

Embodiment 4

The learning procedure with the configuration of FIG. 3 is also a kind of game. A game device can be realized with the above-described configuration as the basis. First, the title of a game or a menu for selecting the degree of difficulty are displayed, and a game player selects the degree of difficulty from the response input portion 15, and the sound source selection control portion 11 selects the Noise-Vocoded Speech Sounds of words or sentences with the selected degree of difficulty. The ratio of correct responses may be recorded or the number of correct responses may be displayed in the display device 14 during a game. When a high mark is obtained, an amusing view appears on the screen as a prize so that the play can be amused. It can be designed in the form of a competition as to how many questions were answered in a predetermined period of time or how many correct responses were provided In such a game, a game device may be designed for handicapped people or may be designed for normal people. The presented content, the presentation speed, and the presented view can be designed as appropriate, depending on the person who uses it.

The game player may select the degree of difficulty of the game by operating the band selecting portion 12. For example, the number of filters may be selected among 1 to 4. The original words or sentences can be understood more easily in the case of four band filters than in the case of one band filter, so that the game player can select the level of the difficulty of the game.

Embodiment 5

Hereinafter, an embodiment of a method for hearing with an aid will be described. FIG. 4 is an example of a flowchart of a method for implementing a function of the hearing aid according to the present invention.

In the sound input procedure (S10), an input sound signal from a microphone of the hearing aid is AD-converted for preparation to supply sound data to the band filtering procedure (S12). This procedure is steadily performed hereinafter.

Next, in the band selection procedure (S11), the number of the band frequencies or the boundary frequencies of the band frequencies for band filtering that is performed in the band filtering procedures (S12) and (S14) below is changed or set, if necessary. This procedure is performed in response to an operation by a user. If there is such an operation, this procedure is omitted. Next, in the band filtering procedure (S12), sound data is filtered, based on the number of the band frequencies or the boundary frequency of the band frequencies of the band filtering that are set. In the envelope extraction procedure (S13), the envelope component data of the filtered sound data is extracted. Then, in the band filtering procedures (S14), noise signals of white noise are filtered, according to the number of the band frequencies or the boundary frequencies of the band frequencies for band filtering that are set, so that band noise signal data is generated. The envelope component data and the band noise signal data are multiplied in the following multiplication procedure (S15), and when the multiplication results are obtained for a plurality of frequency bands, they are accumulated in the adding procedure (S16). The accumulated sound data is Noise-Vocoded Speech Sound data. In the signal presentation procedure (S17), this is presented to the user through an earphone in the form of a DA-converted analog sound signal for listening.

The procedures (S10) to (S17) may be performed sequentially according to FIG. 4, or may be performed in parallel. These procedures can be realized in the form of a program of a digital signal processor (DSP).

The procedures (S11) to (S16) constitute a Noise-Vocoded Speech Sound generation procedure (S100).

The band selection procedure (S11) may be provided with a language automatic recognition procedure for, for example, Japanese, English, German or Chinese, and the number of the frequency bands and the boundary frequencies defining the frequency bands that correspond to the recognized language may be selected. The technique for language automatic recognition is known and therefore is not described in detail here.

Embodiment 6

Hereinafter, an embodiment of a training method will be described. FIG. 5 is an example of a flowchart of the procedures that realize the functions of the training device of the present invention.

When a training program is started, in the sound source selection procedure (S20), a predetermined word or sentence that is to be presented is selected from the sound source signal data and supplied to the Noise-Vocoded Speech Sound generation procedure (S100). The Noise-Vocoded Speech Sound generation procedure (S100) generates Noise-Vocoded Speech Sound data. In the Noise-Vocoded Speech Sound presentation procedure (S21), the generated Noise-Vocoded Speech Sound is converted to an analog sound signal, which is listened to by a trainee through an earphone. In the response procedure (S22), the trainee inputs a word or a sentence that is understood by recognizing the Noise-Vocoded Speech Sound that the trainee heard to the response input portion 15. An evaluation device determines whether or not the response data that has been input is correct in a response evaluation procedure (S23), and in a correct answer presentation procedure (S24), the result of correct or in correct or a correct word or sentence is displayed in the display device. At this point, training for one question ends. A training program menu constituted by a series of questions can be implemented by repeating these procedures in this order.

Embodiment 7

Hereinafter, an embodiment of a game method will be described. If the ratio of correct responses or the scores acquired from correct responses is displayed in the correct answer presentation procedure (S24) of the training device procedure of FIG. 5, procedures for a game method can be obtained.

Embodiment 8

In the hearing aid of FIG. 1, an input signal from a microphone is applied to the band filtering portion 1 through an input terminal 7. However, the input signal may contain an ambient noise component, in addition to a sound component. In this case, the configuration of FIG. 6 can be used. In FIG. 6, the input signal applied to the input terminal 7 from the microphone is applied to the band filtering portion 1 through a sound signal extracting portion 9. The sound signal extracting portion 9 has the function of extracting sound signals from input signals containing ambient noise. Therefore, for example, a technique such as spectrum subtraction is used to suppress noise components other than sound signals contained in input signals.

Embodiment 9

In the training device of FIG. 2 or the training device of FIG. 3 and the game device, when the signals of the sound source signal portion 10 contain ambient noise other than sound components, the signals may be applied to the band filtering portion 1 through the sound signal extracting portion 9 that is described with reference to FIG. 6. Furthermore, in a training device or a game device in which one of two people inputs a word or a sentence through the microphone, and the other person listens to the Noise-Vocoded Speech Sound thereof and guesses the original word or sentence, ambient noise may be mixed, so that it is preferable to provide the sound signal extracting portion 9.

Embodiment 10

FIG. 7 shows a configuration in which signals obtained by converting sound signals to Noise-Vocoded Speech Sounds are previously stored in the sound source signal portion 10 of the training device of FIG. 3 or the game device, and a trainee listens to an output signal therefrom through a headphone 13. Therefore, it is not necessary to provide the band filtering portions 1 and 4, the envelope extracting portion 2, the multiplying portion 3, the noise source 5, the adding portion 6, the band selecting portion 12 in FIG. 3. The same configuration can be used in the training device of FIG. 2.

In all of the above-described embodiments, the number of the band filters of the band filtering portions 1 and 2 is 4 as a typical example. However, the number thereof is not limited to 4 and can be 4 or less or more. The number of the frequency bands that is suitable, depending on the situation, can be used.

A recording medium on which a program for a procedure for a hearing aid method, a procedure for a training method, or a procedure for a game method of the present invention is recorded includes ROM, RAM, flexible disks, CD-ROM, DVD, memory cards, hard disk on which the program is recorded. Furthermore, the medium includes communication media such as telephone networks, and transmission paths.

INDUSTRIAL APPLICABILITY

The present invention relates to a hearing aid, a hearing training device, a game device and other devices that employ Noise-Vocoded Speech Sound obtained by subjecting at least one frequency band signal of a sound signal to noise. In particular, the present invention relates to devices suitable to people with a neural disorder or trainers for training for recovery from a neural disorder.

The invention claimed is:

1. A hearing aid comprising:

a first band filtering portion including a band filter which extracts a signal with a predetermined frequency band when a sound signal is input to the hearing aid;

an envelope extracting portion including an envelope extractor which extracts an envelope of the frequency band signal extracted by the band filter;

a noise source generating a noise for deteriorating the input sound signal;

a second band filtering portion including a band filter which extracts a noise signal corresponding to the predetermined frequency band from the noise generated by the noise source; and a multiplying portion which subjects each said sound signal with a predetermined frequency band to said noise signal corresponding to the predetermined frequency band by multiplying an output from the envelope extracting portion by an output from the second band filtering portion, and configures a Noise-Vocoded Speech Sound signal therefrom;

wherein the Noise-Vocoded Speech Sound signal is outputted by the hearing aid.

2. A hearing aid comprising:

a first band filtering portion including a plurality of band filters, each said filter extracting a frequency band signal with a predetermined band when a sound signal is input to the hearing aid;

an envelope extracting portion including a plurality of envelope extractors, each said extractor extracting an envelope of a corresponding frequency band signal;

a noise source generating a noise for deteriorating the input sound signal;

a second band filtering portion including a plurality of band filters, each said filter extracting a noise signal corresponding to a predetermined band from the noise outputted by the noise source;

a multiplying portion subjecting said frequency band signals with the predetermined frequency bands to said noise signals corresponding to the predetermined frequency bands by multiplying outputs from the envelope extracting portion by corresponding outputs from the second band filtering portion; and an adding portion accumulating outputs from the multiplying portion, thereby configuring a Noise-Vocoded Speech Sound signal;

wherein the Noise-Vocoded Speech Sound signal is outputted by the hearing aid.

3. The hearing aid according to claim 1 or 2, wherein at least one of a number of the band filters for division into frequency band signals and a frequency of a frequency band boundary can be changed at least through language.

4. The hearing aid according to claim 1 or 2, wherein at least one of a number of the band filters for division into frequency band signals and a frequency of a frequency band boundary can be changed through automatic language recognition.

5. A training device comprising:

a first band filtering portion including a band filter which extracts a signal with a predetermined frequency band when a sound signal is input to the training device;

an envelope extracting portion including an envelope extractor which extracts an envelope of the frequency band signal extracted by the band filter;

a noise source generating a noise for deteriorating the input sound signal;

a second band filtering portion including a band filter which extracts a noise signal corresponding to the predetermined frequency band from the noise generated by the noise source; and a multiplying portion which subjects each said sound signal with a predetermined frequency band to said noise signal corresponding to the predetermined frequency band by multiplying an output from the envelope extracting portion by an output from the second band filtering portion, and configures a Noise-Vocoded Speech Sound signal therefrom; wherein the training device outputs the Noise-Vocoded Speech Sound signal, and when the training device receives a response from a trainee the training device determines whether the response is correct and outputs an indication as to whether the response is correct or incorrect is outputted.

6. A training device comprising:

a first band filtering portion including a plurality of band filters, each said filter extracting a frequency band signal with a predetermined band when a sound signal is input to the training device;

an envelope extracting portion including a plurality of envelope extractors, each said extractor extracting an envelope of a corresponding frequency band signal;

a noise source generating a noise for deteriorating the input sound signal;

a second band filtering portion including a plurality of band filters, each said filter extracting a noise signal corresponding to a predetermined band from the noise outputted by the noise source;

a multiplying portion subjecting said frequency band signals with the predetermined frequency bands to said noise signals corresponding to the predetermined frequency bands by multiplying outputs from the envelope extracting portion by corresponding outputs from the second band filtering portion; and an adding portion accumulating outputs from the multiplying portion, thereby configuring a Noise-Vocoded Speech Sound signal;

wherein the training device outputs the Noise-Vocoded Speech Sound signal, and when the training device receives a response from a trainee the training device determines whether the response is correct and outputs an indication as to whether the response is correct or incorrect.

7. The training device according to claim 5 or 6, wherein at least one of a number of the band filters for division into frequency band signals and a frequency of a frequency band boundary can be changed at least through language.

8. The training device according to claim 5 or 6, wherein at least one of a number of the band filters for division into frequency band signals and a frequency of a frequency band boundary can be changed through automatic language recognition.

9. A game device outputting a Noise-Vocoded Speech Sound signal, comprising:

a first band filtering portion including a band filter which extracts a signal with a predetermined frequency band when a sound signal is input to the game device;

an envelope extracting portion including an envelope extractor which extracts an envelope of the frequency band signal extracted by the band filter;

a noise source generating a noise for deteriorating the input sound signal;

a second band filtering portion including a band filter which extracts a noise signal corresponding to the predetermined frequency band from the noise generated by the noise source; and a multiplying portion which subjects each said sound signal with a predetermined frequency band to said noise signal corresponding to the predetermined frequency band by multiplying an output from the envelope extracting portion by an output from the second band filtering portion, and configures a Noise-Vocoded Speech Sound signal therefrom; wherein the game device outputs the Noise-Vocoded Speech Sound signal, and when the game device receives a response from a game player the game device determines whether the response is correct and outputs an indication as to whether the response is correct or incorrect is outputted.

10. A game device outputting a Noise-Vocoded Speech Sound signal, comprising:

a first band filtering portion including a plurality of band filters, each said filter extracting a frequency band signal with a predetermined band when a sound signal is input to the game device;

an envelope extracting portion including a plurality of envelope extractors, each said extractor extracting an envelope of a corresponding frequency band signal;

a noise source generating a noise for deteriorating the input sound signal;

a second band filtering portion including a plurality of band filters, each said filter extracting a noise signal corresponding to a predetermined band from the noise outputted by the noise source;

a multiplying portion subjecting said frequency band signals with the predetermined frequency bands to said noise signals corresponding to the predetermined frequency bands by multiplying outputs from the envelope extracting portion by corresponding outputs from the second band filtering portion; and an adding portion accumulating outputs from the multiplying portion, thereby configuring a Noise-Vocoded Speech Sound signal;

wherein the game device outputs the Noise-Vocoded Speech Sound signal, and when the game device receives a response from a game player the game device determines whether the response is correct and outputs an indication as to whether the response is correct or incorrect.

11. The game device according to claim 9 or 10, wherein at least one of a number of the band filters for division into frequency band signals and a frequency of a frequency band boundary can be changed at least through language.

12. The game device according to claim 9 or 10, wherein at least one of a number of the band filters for division into frequency band signals and a frequency of a frequency band boundary can be changed through automatic language recognition.

13. A sound output device, which generates a Noise-Vocoded Speech Sound signal in which a component of a sound source signal is subjected to noise, comprising:

a first band filtering portion having a plurality of band filters extracting signals with predetermined frequency bands from a sound signal stored in a sound source signal portion;

an envelope extracting portion having an envelope extractor extracting envelopes of the signals with the predetermined bands extracted by the band filters;

a noise source generating a noise for deteriorating the sound signal;

a second filtering portion having a plurality of band filters extracting noise signals corresponding to the predetermined frequency bands from the noise generated by the noise source;

a multiplying portion subjecting said signals with the predetermined frequency bands to said noise signals corresponding to the predetermined frequency bands by multiplying outputs from the envelope extracting portion by corresponding outputs from the second band filtering portion; and an adding portion accumulating outputs from the multiplying portion, and configuring a Noise-Vocoded Speech Sound signal therefrom;

wherein the noise output device permits at least one of a number of the band filters for division into frequency band signals and a frequency of a frequency band boundary to be changed at least through language.

14. A sound output device which generates a Noise-Vocoded Speech Sound signal in which a component of a sound source signal is subjected to noise, comprising:

a first band filtering portion having a plurality of band filters extracting signals with predetermined frequency bands from a sound signal stored in a sound source signal portion;

an envelope extracting portion having an envelope extractor extracting envelopes of the signals with the predetermined bands extracted by the band filters;

a noise source generating a noise for deteriorating the sound signal;

a second filtering portion having a plurality of band filters extracting noise signals corresponding to the predetermined frequency bands from the noise generated by the noise source;

a multiplying portion subjecting said signals with the predetermined frequency bands to said noise signals corresponding to the predetermined frequency bands by multiplying outputs from the envelope extracting portion by corresponding outputs from the second band filtering portion; and an adding portion accumulating outputs from the multiplying portion, and configuring a Noise-Vocoded Speech Sound signal therefrom, wherein the noise output device permits at least one of a number of the band filters for division into frequency band signals and a frequency of a frequency band boundary to be changed through automatic language recognition.

15. The hearing aid according to claim 1 or 2, comprising a sound signal extractor for extracting only a sound component from an input signal which includes an ambient noise, wherein the band filter included in the first band filtering portion extracts the signal with the predetermined band from a signal of the sound component extracted by the sound signal extractor.

16. The training device according to claim 5 or 6, comprising a sound signal extractor for extracting only a sound component from a signal which includes an ambient noise, wherein the band filter included in the first band filtering portion extracts the signal with the predetermined band from a signal of the sound component extracted by the sound signal extractor.

17. The game device according to claim 9 or 10, comprising a sound signal extractor for extracting only a sound component from a signal which includes an ambient noise, wherein the band filter included in the first band filtering portion extracts the signal with the predetermined band from a signal of the sound component extracted by the sound signal extractor.

18. The sound output device according to claim 13 or 14, comprising a sound signal extractor for extracting only a sound component from a sound signal which includes an ambient noise, wherein the band filter included in the first band filtering portion extracts the signal with the predetermined band from a signal of the sound component extracted by the sound signal extractor.

19. The hearing aid according to claim 1 or 2, wherein the Noise-Vocoded Speech Sound signal is adapted to be recognized by utilizing a healthy brain part of a hearing-impaired person such that a part of recognizable sound information may be compensated by a part of the person's brain other than the healthy part, so that the input sound signal may be understood by the hearing-impaired person.

20. The training aid according to claim 5 or 6, wherein the Noise-Vocoded Speech Sound signal is adapted to be recognized by utilizing a healthy brain part of a hearing-impaired person such that a part of recognizable sound information may be compensated by a part of the person's brain other than the healthy part, so that the input sound signal may be understood by the hearing-impaired person.

21. The game device according to claim 9 or 10, wherein the Noise-Vocoded Speech Sound signal is adapted to be recognized by utilizing a healthy brain part of a hearing-impaired person such that a part of recognizable sound information may be compensated by a part of the person's brain other than the healthy part, so that the input sound signal may be understood by the hearing-impaired person.

* * * * *

UNITED STATES PATENT AND TRADEMARK OFFICE

CERTIFICATE OF CORRECTION

PATENT NO. : 7,502,483 B2
APPLICATION NO. : 10/530342
DATED : March 10, 2009
INVENTOR(S) : Rikimaru It is certified that error appears in the above-identified patent and that said Letters Patent is hereby corrected as shown below:

Column 1:
Line 7, change “game device and” to --game device, and--.
Line 11, change “disorder and trainers” to --disorder, and to trainers--.
Line 18, change “audio input in” to --audio input, in--.
Line 20, change “disorder in order” to --disorder, in order--.

Column 2:
Line 2, change “subjecting a ingle” to --subjecting a single--.

Column 4:
Line 26, change “divided to a single” to --divided into a single--.

Column 5:
Line 59, change “portion 11 analyses” to --portion 11 analyzes--.

Column 6:
Line 5, change “presentation of and the responses to the ten” to --presentation of, and the responses to, the ten--.
Line 33, change “game or a menu” to --game, or a menu --; change “of difficulty are” to --of difficulty, is--.
Line 42, change “play can be amused.” to --player can be amused.--.
Line 45, change “were provided In” to --were provided. In--.

UNITED STATES PATENT AND TRADEMARK OFFICE

CERTIFICATE OF CORRECTION

PATENT NO. : 7,502,483 B2
APPLICATION NO. : 10/530342
DATED : March 10, 2009
INVENTOR(S) : Rikimaru It is certified that error appears in the above-identified patent and that said Letters Patent is hereby corrected as shown below:

Column 7:

Line 39, change "is known and therefore" to --is known, and therefore--.

Line 65, change "result of correct or in correct" to --result of "correct" or "incorrect",--.

Line 66, change "or sentence is displayed" to --or sentence, is displayed--.

Column 8:

Line 7, change "responses or the scores" to --responses, or the scores--.

Line 8, change "correct responses is" to --correct responses, is--.

Signed and Sealed this

Sixteenth Day of June, 2009

JOHN DOLL
*Acting Director of the United States Patent and Trademark Office*